United States Patent [19]

Götz et al.

[11] Patent Number: 4,520,731

[45] Date of Patent: Jun. 4, 1985

[54] PROJECTILE CONSTRUCTION AND METHOD OF MAKING THE PROJECTILE

[75] Inventors: Udo Götz, Trossingen; Winifred Gleichauf, Oberndorf; Oswin Günther, Schramberg, all of Fed. Rep. of Germany

[73] Assignee: Mauser-Werke Oberndorf GmbH, Fed. Rep. of Germany

[21] Appl. No.: 435,500

[22] Filed: Oct. 20, 1982

[30] Foreign Application Priority Data

Oct. 28, 1981 [DE] Fed. Rep. of Germany ..... 3142636

[51] Int. Cl.[3] ..... F42B 31/00

[52] U.S. Cl. ..... 102/527

[58] Field of Search ..... 102/501, 514, 520–523, 102/524–529

[56] References Cited

U.S. PATENT DOCUMENTS

| | | | |
|---|---|---|---|
| 55,761 | 6/1866 | Broadwell | 102/527 |
| 2,994,274 | 8/1961 | Dunlap | 102/523 |
| 2,996,012 | 8/1961 | Butler | 102/527 |
| 2,998,779 | 9/1961 | MacRoberts | 102/523 |

*Primary Examiner*—Harold J. Tudor

*Attorney, Agent, or Firm*—McGlew and Tuttle

[57] ABSTRACT

A projectile particularly for automatic firearms in high performance machine guns comprises a cylindrical projectile body which has an annular groove around its circumference with rib portions extending radially outwardly of the bottom of the groove which are of radial extent no greater than the outer surface of the projectile body. The groove has end walls which are substantially perpendicular to the exterior surface of the body. A plastic rotating band has its inner periphery anchored in the groove with the rib portions extending to receiving recesses or grooves of the band. The ribs are advantageously radially extending elements which have their outer ends bent in axial directions and they are arranged so that there are portions of the groove of the body on each side thereof. In accordance with the method of manufacturing a projectile body, a form tool is used to effect the recessing of the projectile body or jacket to produce the intermediate ribs which are of substantially rectangular cross section. Thereafter the ribs are bent in a desired direction under a pressure application while simultaneously producing knurls or a roughened surface on the ribs. Thereafter the rotating band is formed in the groove and projects outwardly from the surface of the projectile body. The band is formed by injecting a preferably fiber filled sooth pigmented plastic into the projectile body grooves and around the ribs which are formed in the groove.

4 Claims, 8 Drawing Figures

PROJECTILE CONSTRUCTION AND METHOD OF MAKING THE PROJECTILE

FIELD AND BACKGROUND OF THE INVENTION

The invention relates in general to missiles and in particular to a new and useful missile or projectile for use with rapid firearms and having a rotating band around the body of the missile.

U.S. Pat. No. 2,996,012 discloses a projectile body having a recess in its rear end portion, comprising circular grooves and intermediate ribs: The ribs are given a substantially trapezoidal cross section by radial pressure. The radial boundary walls of the recess are undercut to conform to the ribs. On their head portions, the intermediate ribs are axially knurled. The plastic rotating band is injected into the recess thus shaped. An operation of undercutting the intermediate ribs is advantageously avoided in this prior art design. Further, the design is suitable also for broad plastic rotating bands. What is disadvantageous is that an undercut shape can be obtained according to the reference only by upsetting or squeezing under high pressures. This results in an only small deformation of the intermediate ribs, and the rotating band has little hold in the recess. Also, according to the reference, the shape of the intermediate ribs is always symmetrical so that the arrangement may be suitable only for conditions with discharge loads having a preferential direction.

The life of the gun barrel is extended if plastic is used for the rotating band of the ammunition. The anchoring of the plastic rotating band to the projectile body is therefore very important. On the one hand, the rotating band must be prevented from peeling off or getting loose and on the other hand, the solution must be easy and inexpensive to manufacture.

SUMMARY OF THE INVENTION

The invention is directed to a projectile body in which a plastic rotating band around the body is prevented from peeling off, bulging, or getting loose, and may be designed as a single broad rotating band, and which is simple and inexpensive to manufacture. The invention is further directed to a method of manufacturing such a projectile body which is simple and permits a series manufacture.

In accordance with the invention, a projectile body particularly for automatic rapid firearms and high-performance machine guns comprises a cylindrical projectile body having an annular groove around its circumference with a grooved bottom surface having ribbed portions extending radially outwardly of the bottom surface and being of a radially extent no greater than the outer surface of the body. The end walls bounding the groove are substantially perpendicular to the exterior surface of the body and a plastic rotating band is formed in the groove and extends outwardly of the surface of the body and is anchored by embedding interengagement of the ribs into the band.

The inventive design prevents the plastic rotating band from being peeled off at the discharge. Further the invention is applicable to high-performance machine guns, where extremely high loads occur. The special design of the projectile body aimed at anchoring the rotating band ensures a firm fit of the band even at very high angular accelerations. In this respect, the inventive design is suited equally for a uniform and an increasing rifling. The position and shape are optimized to allow omitting of the otherwise usual undercutting of intermediate ribs. The height of the intermediate ribs in accordance with the invention is such that as the lands of the rifling cut into the plastic of the rotating band, the band is neither displaced nor torn away.

The invention is further advantageous for providing a single broader rotating band instead of two or more narrow bands. A projectile body with such a single plastic rotating band is manufactured in sequential operations including recessing the projectile jacket with a form tool, thereby producing at the same time intermediate ribs having a substantially rectangular cross section, bending the thus produced ribs under a proper pressure in the desired direction or to a desired shape, while at the same time knurling the ribs and/or the area therebetween and ecapsulating the grooves and ribs with a plastic, preferably filled with fibers and soothpigmented, in an injection-molding process, to form the rotating band.

Accordingly, it is an object of the invention to provide a projectile which has a cylindrical body with an annular groove around its circumference which has a grooved bottom wall with rib portions extending radially outwardly of the bottom wall engaged into a rotating cylindrical band, the ends of the groove having surfaces which substantially are perpendicular to the outer surface of the projectile body.

A further object of the invention is to provide a projectile which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
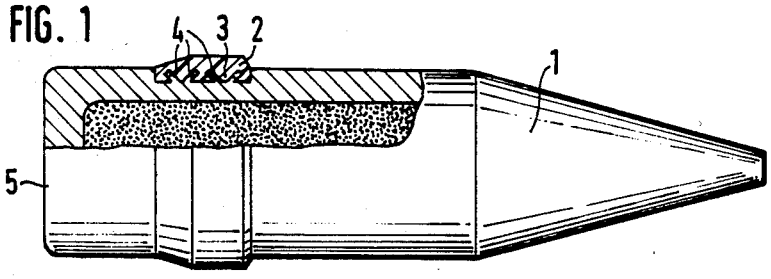
FIG. 1 is a side elevational view partly in section of a projectile body having a plastic rotating band constructed in accordance with the invention.

Referring to the drawings in particular the invention embodied therein comprises a projectile particularly for automatic rapid firearms and high-performance machine guns which comprises a projectile body 1 having a forward tapered end and a rear end 5 with an annular groove 3 defined around its circumference. The groove 3 has a bottom surface with rib portions 4 extending radially and axially outwardly of the bottom surface.

Ribs 4 are of a radial extent no greater than the outer surface of the projectile body. The body has end walls bounding the groove 32 and designated 10 and 10' which are substantially perpendicular to the exterior surface of the body. A plastic band 2 is integrally formed with the body with its inner surface bounded into the interior of the groove 3 and is secured by the embedded ribs 4.

FIG. 1 shows a projectile body 1 with an injection-molded rotating band 2, partly in section. Recesses or grooves 3, with bent intermediate ribs 4 for anchoring the rotating band 2 are provided adjacent the rear end 5 of the projectile body 1.

FIGS. 2–5 show preferred embodiments of ribs 4, 4*a*, 4*b* and 4*c* respectively. According to FIG. 2, two pairs of ribs are provided which extends in a V configuration while forming the grooves 3 having a center position 3*a* and end portions 6*a* and 6*b*. According to FIG. 3, the outer circumferential surface 7 of the two ribs 4*a* is provided with knurls 8. Also knurled, as shown at 8, is the bottom 9 of the center groove portion 3*a* between ribs 4*a*, to improve the force transmission. In all the embodiments, the axial boundary walls 10 and 10' of the groove 32 extend at right angles to the circumferential surface 12 of the projectile body.

Also in all the embodiments, the width of the intermediate ribs is at most equal to the width of the grooves and to half the height of the ribs. The width of each rib is thus less than its length from the base of the groove 6, outwardly. At their maximum height, the intermediate ribs 4*a* are flush with the circumferential surface 12 of the projectile body, so that as the lands of the rifling of the barrel cut in, the plastic of rotating band 2 in the rib areas can neither be displaced nor torn away.

Figure 3:
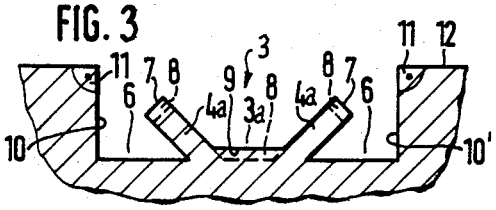
FIG. 3 is a view similar to FIG. 2, of another embodiment of the invention.
Figure 2:
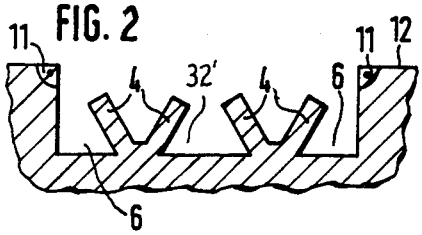
FIG. 2 is an enlarged detail view of the structure shown in FIG. 1.

FIG. 2 shows two pairs of ribs 4 in V configuration substantially as according to FIG. 3 but instead of the single V of FIG. 3.

Figure 4:
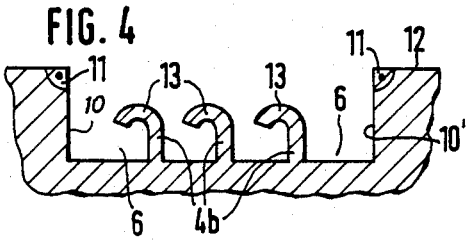
FIGS. 4,5, and 6 are views similar to FIG. 2 of still further embodiments of the invention, the embodiment of FIG. 6 being substantially the same as that of FIG. 3.
Figure 5:
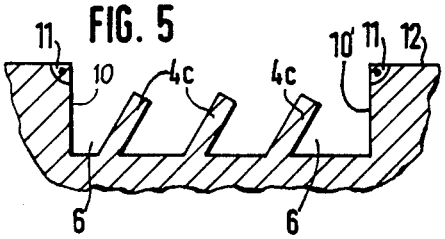

According to FIG. 4, the edge portions 13 of ribs 4*b* are bent to open loops or bars. FIG. 5 shows three ribs which are bent to a saw tooth confirguration, but otherwise are simular to FIG. 2.

Figure 6:
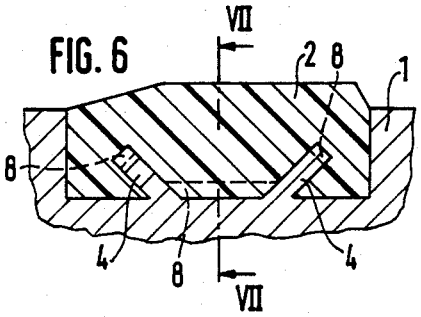
Figure 7:
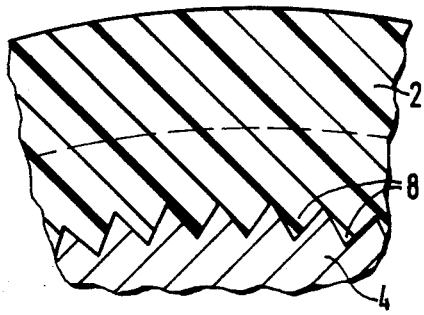
FIG. 7 is an enlarged sectional view taken along the lines VII—VII of FIG. 6.

The inventive manner of firm anchoring of rotating band 2 to projectile body 1 is made clear by FIGS. 6 and 7 similar to the embodiment of FIG. 3. While ribs 4*a* in V configuration substantially secure the rotating band 2 in the axial direction of projectile body 1, knurls 8 ensure a firm hold even at a strong twist and high angular accelerations, as illustrated in FIG. 7.

Figure 8:
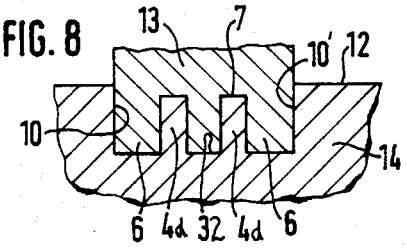
FIG. 8 is a sectional view of a missile body showing a form tool in the process of cutting the body.

Grooves 32 and ribs 4*d* are produced in a recessing operation by means of a form tool 13 cutting into projectile jacket 14 as indicated in FIG. 8. Both circular grooves 6*a* and 6*b* with boundary walls 10 and 10' and ribs 4*d* with a groove 3 therebetween, are thereby formed. Ribs 4*d* extend generally at right angles to circumferential projectile surface 12 and have a rectangular cross section. They extend slightly below the level of circumferential projectile surface 12. In a second operation, ribs 4*a* are bent under proper pressure in the desired direction or to a desired position or shape. At the same time, the knurls 8 between ribs 4*a* and on the outer edges 7 of the ribs are produced by means of a knurling tool. The knurls 8 advantageously extend in the axial direction of the projectile. Upon finishing the projectile body in this way, the rotating band 2 is formed in and around grooves 3, 6*a*, 6*b* and ribs 4, injection molding operation. Preferably, a fiber-filled plastic with sooth pigmentation is used for this purpose, to ensure a necessary strength, stabilizing effect, and extended storage capability.

Instead of knurls in the form of axial grooves, other depressions, grooves, impressions or knurled patterns may be provided on and between ribs 4.

While specific embodiments of the invention have been shown and described in detail to illustrate the application of the principles of the invention, it will be understood that the invention may be embodied otherwise without departing from such principles.

What is claimed is:

1. A projectile, particularly for automatic rapid firearms and high performance machine guns, comprising:

a projectile body having a projectile jacket surface, said protective body having a circular groove therearound near a rear end of said projectile body, said circular groove having opposite radially extending walls perpendicular to said projectile jacket surface, said circular groove having a bottom extending between said walls;

a plastic rotating band anchored in said circular groove;

at least two spaced apart narrow ribs extending outwardly from said circular groove bottom, each of said ribs having a pair of parallel side walls extending at an acute angle to a radial perpendicular direction parallel to said walls and defining an intermediate groove therebetween, a width of each of said narrow ribs being at most equal to a width of said intermediate groove and being less than a length of each rib from said groove bottom toward said projectile jacket surface, each rib extending at most to a plane containing said projectile jacket surface; and knurls formed on said intermediate groove.

2. A projectile according to claim 1, wherein said at least two narrow ribs extend obliquely outwardly in opposite directions from said bottom to form a V-configuration in said circular groove.

3. A projectile according to claim 2, including knurls formed on an outer edge of each rib which is spaced away from said circular groove bottom.

4. A projectile according to claim 1, wherein each of said ribs extends in the same direction.

* * * * *